US009523481B2

(12) United States Patent
Kim

(10) Patent No.: US 9,523,481 B2
(45) Date of Patent: Dec. 20, 2016

(54) LED LIGHTING APPARATUS

(71) Applicant: KMW INC., Hwaseong, Gyeonggi-Do (KR)

(72) Inventor: Duk Yong Kim, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 52 days.

(21) Appl. No.: 14/274,120

(22) Filed: May 9, 2014

(65) Prior Publication Data

US 2014/0247594 A1 Sep. 4, 2014

Related U.S. Application Data

(63) Continuation of application No. PCT/KR2012/009469, filed on Nov. 9, 2012.

(30) Foreign Application Priority Data

Nov. 9, 2011 (KR) ..... 10-2011-0116483

(51) Int. Cl.
*F21S 4/00* (2016.01)
*F21V 14/02* (2006.01)
(Continued)

(52) U.S. Cl.
CPC ..... *F21V 14/02* (2013.01); *F21S 8/065* (2013.01); *F21V 23/002* (2013.01);
(Continued)

(58) Field of Classification Search
CPC .... F21V 14/02; F21V 29/2206; F21V 23/008; F21V 29/773; F21V 23/002; F21S 8/065
See application file for complete search history.

(56) References Cited

U.S. PATENT DOCUMENTS 1,731,942 A 10/1929 Simmons
5,385,482 A 1/1995 Rottner
(Continued)

FOREIGN PATENT DOCUMENTS

CN 2814114 Y 9/2006
DE 202009005445 7/2009
(Continued)

OTHER PUBLICATIONS

Decision on Grant for RU Application No. 2014123001 (5 Pages).
Decision to Grant for CN Application No. 201280066527.3.

*Primary Examiner* — Evan Dzierzynski
(74) *Attorney, Agent, or Firm* — Mintz Levin Cohn Ferris Glovsky and Popeo, P.C.; Kongsik Kim; Colleen H. Witherell

(57) ABSTRACT

The present invention relates to an LED lighting apparatus. The LED lighting apparatus includes: a power source housing provided with a power supply unit therein and having a plurality of connection parts disposed on a bottom surface thereof; a ring-shaped frame on which a connection frame coupled to the connection parts of the power source housing is disposed, with the ring-shaped frame accommodating a transmission line through which power from the power supply unit is supplied; and a plurality of lighting part housings coupled to a lower portion of the frame to receive the power through the transmission line, thereby applying the power to the accommodated LED to emit light. Thus, the lighting part housings of the LED lighting apparatus may be changed in quantity and position to vary light distribution and luminance.

8 Claims, 3 Drawing Sheets

(51) Int. Cl.

| | |
|---|---|
| ***F21V 23/00*** | (2015.01) |
| ***F21V 29/77*** | (2015.01) |
| ***F21S 8/06*** | (2006.01) |
| *F21Y 113/00* | (2016.01) |
| *F21Y 101/00* | (2016.01) |

(52) U.S. Cl.
CPC ..... *F21V 23/008* (2013.01); *F21V 29/773* (2015.01); *F21Y 2101/00* (2013.01); *F21Y 2113/00* (2013.01)

(56) References Cited

U.S. PATENT DOCUMENTS

| | | | | |
|---|---|---|---|---|
| 7,703,951 | B2 * | 4/2010 | Piepgras | F21K 9/00 362/294 |
| 2006/0262544 | A1 * | 11/2006 | Piepgras | F21K 9/00 362/373 |
| 2009/0237927 | A1 * | 9/2009 | Zheng | F21S 2/005 362/235 |
| 2012/0307486 | A1 * | 12/2012 | Gordin | F21S 2/00 362/223 |

FOREIGN PATENT DOCUMENTS

| | | | |
|---|---|---|---|
| EP | 2261550 | | 12/2010 |
| JP | 2009-218209 | A | 9/2009 |
| KR | 2009-0108222 | A | 10/2009 |
| KR | 10-0966582 | B1 | 6/2010 |
| KR | 2011-0008826 | A | 1/2011 |
| KR | 10-1079151 | B1 | 11/2011 |
| RU | 99104 | U1 | 11/2010 |
| RU | 2430300 | C1 | 9/2011 |

* cited by examiner

LED LIGHTING APPARATUS

CROSS-REFERENCE TO RELATED APPLICATION

The present application is a continuation of International Application No. PCT/KR2012/009469 filed on Nov. 9, 2012, which claims priority to Korean Application No. 10-2011-0116483 filed on Nov. 9, 2011, which applications are incorporated herein by reference.

TECHNICAL FIELD

The present invention relates to an LED lighting apparatus, and more particularly to an LED lighting apparatus by which an intensity of illumination and a distribution of light can be changed according to an in-use purpose by using a plurality of detachable illumination units.

BACKGROUND ART

In recent years, development of lighting apparatuses using an LED as a light source has been accelerated, due to the fact that existing lighting apparatuses consume much electric power and should be frequently replaced due to a short life span thereof.

Currently, lighting apparatuses using an LED as a light source are replacing existing fluorescent lights or light bulbs. The lighting apparatuses are installed on a ceiling of the interior of a building and illuminate a relatively wide area at a uniform intensity of illumination.

However, an individual area is intensively illuminated to create a brighter environment in a factory for precise work or a space for design work, so that precise work can be easily performed and an inspection of a product can be performed more precisely.

A representative lighting apparatus using an LED for intensive illumination is disclosed in Korean Patent Application Publication No. 10-2009-0108222.

According to Korean Patent Application Publication No. 10-2009-0108222, a circular housing provides intensive illumination and the heat emitted from the LED is dually radiated through a first heat radiating fin and a second heat radiating fin.

However, although the structure improves radiation of heat generated by the LED, the housing is circular so that it is difficult to radiate the heat generated by the LED provided at a central portion of the circular housing.

Further, since the path along which heat is transferred is long, heat may not be radiated easily.

In addition, it is difficult to change a light distribution or an intensity of illumination at need.

SUMMARY

Accordingly, the present invention has been made in an effort to solve the above-mentioned problems, and it is an object to provide an LED lighting apparatus by which a light distribution and an intensity of light can be varied according to an intention of a user.

Another object of the present invention is to provide an LED lighting apparatus which can easily radiate heat generated by an illumination unit and a power supply, and prevent heat generated by the power supply from being transferred to the illumination unit, thereby preventing shortening of a life span of an LED.

In accordance with an aspect of the present invention, there is provided an LED lighting apparatus including: a power source housing having a power supply therein and having a plurality of connectors on a lower surface thereof; an annular frame having a connecting frame coupled to the connectors of the power source housing and in which a transmission line for supplying electric power of the power supply is accommodated; and a plurality of illumination unit housings coupled to a lower portion of the frame to receive electric power through the transmission line for applying the electric power to an accommodated LED to emit light.

According to the LED lighting apparatus of the present invention, connection frames are fixedly installed at a lower portion of a power source housing in which a power supply is accommodated to be spaced apart from each other by a predetermined separation, a plurality of detachable illumination unit housings are installed at a lower side of the connecting frames, and a light distribution and an intensity of illumination can be varied by changing the number and locations of the illumination unit housings.

Further, according to the LED lighting apparatus of the present invention, illumination unit housings are arranged in the connecting frames in a ring shape, improving an intensity of illumination.

Further, according to the LED lighting apparatus of the present invention, heat radiating fins are provided in the power source housing and the illumination unit housing, so that the heat generated by an LED and the heat generated by the power supply can be individually radiated, making it possible to improve heat radiation characteristics.

In addition, according to the LED lighting apparatus of the present invention, a life span of an LED can be prevented from being influenced by heat generated by the power supply of the power source housing. This is done by preventing heat from being transferred between the power source housing and the illumination unit housing due to a space between the power source housing and the illumination unit housing, thereby making it possible to prevent shortening of the life span of the LED.

DETAILED DESCRIPTION

Hereinafter, a configuration and an operation of an LED lighting apparatus according to the present invention will be described in detail with reference to the accompanying drawings.

Figure 1:
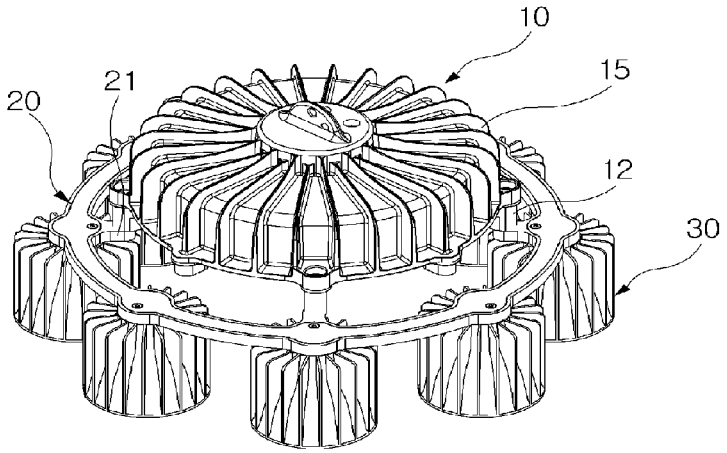
FIG. 1 is a perspective view showing a coupled state of an LED illumination apparatus according to an embodiment of the present invention.
Figure 2:
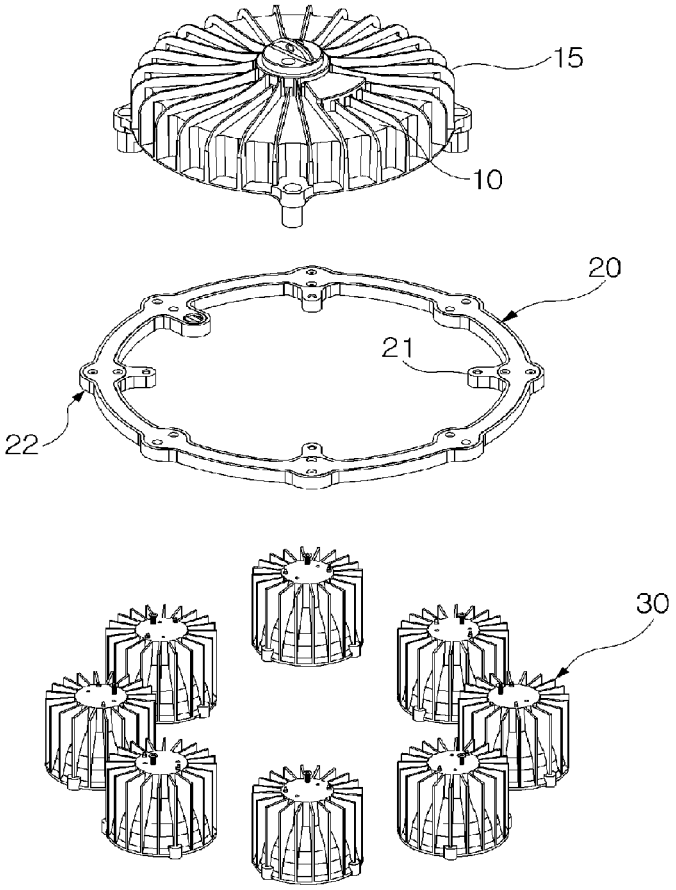
FIG. 2 is an exploded perspective view showing the LED illumination apparatus according to the embodiment of the present invention.

FIG. 1 is a perspective view showing a coupled state of an LED illumination apparatus according to an embodiment of the present invention. FIG. 2 is an exploded perspective view of FIG. 1, and FIG. 3 is a sectional view of FIG. 1.

Figure 3:
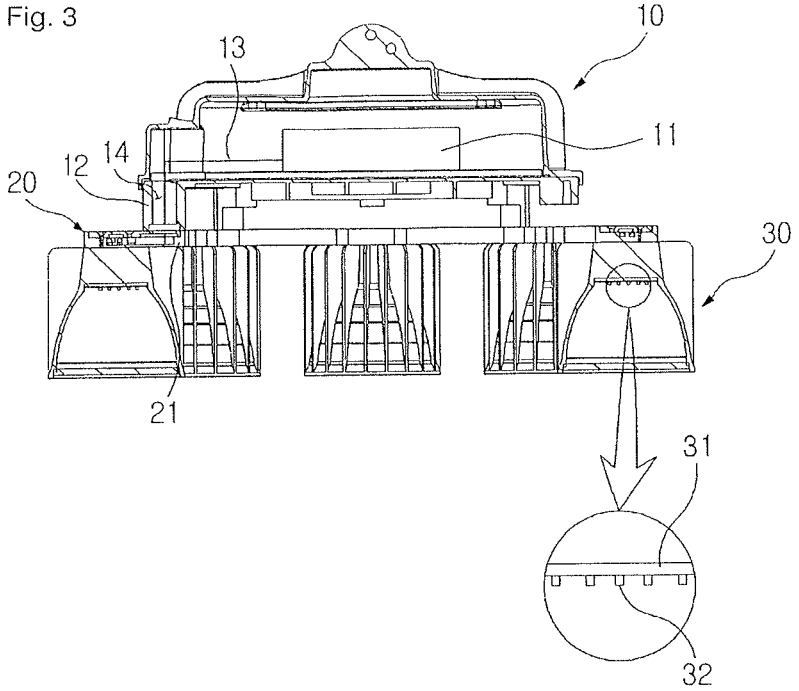
FIG. 3 is a sectional view showing the LED illumination apparatus according to the embodiment of the present invention.

Referring to FIGS. 1 to 3, the LED lighting apparatus according to the embodiment of the present invention includes a power source housing 10 provided with a power supply 11 therein and having a connector 12 at a lower portion thereof, a frame 20 including a connecting frame 21 coupled to the connector 12 of the power source housing 10 and having a space between the frame 20 and the power source housing 10, and an illumination unit housing 30 coupled to a plurality of coupling units 22 provided at a lower portion of the frame 20 to receive electric power from the power supply 11 of the power source housing 10 and supply electric power to a substrate 31 including an LED 32 mounted therein.

Then, because a diameter of the connecting frame 21 is larger than a diameter of the power source housing 10, heat radiation of the illumination unit housing 30 may be improved.

Hereinafter, a configuration and an operation of the embodiment of the present invention will be described in more detail.

First, the power source housing 10 has a circular or polygonal plane and has a space for accommodating the power supply 11 therein. The power supply 11 is adapted to supply static source, and the electric power of the power supply 11 is supplied through a transmission line 13. The transmission line 13 is connected to the connecting frame 21 of the frame 20 through a vertical through-hole 14 provided inside the connector 12.

Heat radiating fins 15 radially extending from an upper central side of the power source housing 10 are provided on an upper surface and a side surface of the power source housing 10 to radiate heat generated by the power supply 11. In particular, the power source housing 10 has a structure by which heat generated by the power supply 11 can be emitted through natural convection more efficiently, which will be described below in more detail.

Figure 4:
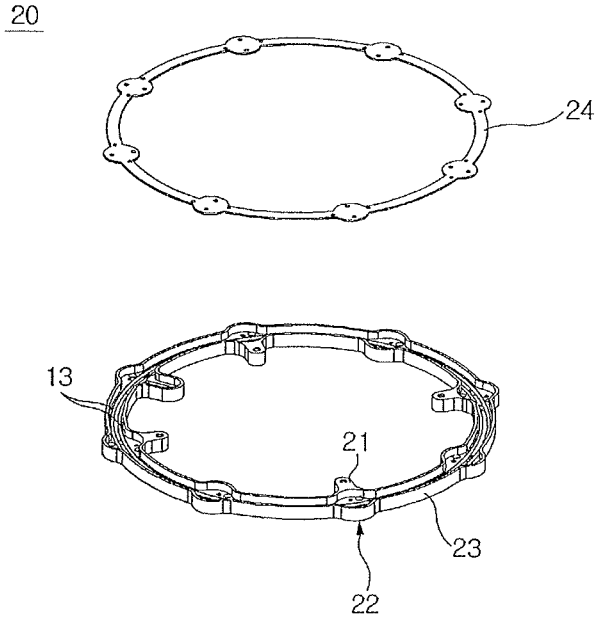
FIG. 4 is an exploded perspective view showing a frame unit applied to the present invention.

FIG. 4 is an exploded perspective view of the frame 20.

Referring to FIG. 4, the frame 20 includes a frame body 23 having an accommodating space therein and having a diameter larger than that of the power source housing 10, a connecting frame 21 protruding toward an inside of the frame body 23, for accommodating the transmission line 13 such that the transmission line 13 is connected to the frame body 23, and a coupling unit 22 provided in the frame body 23 to provide a space to which the illumination unit housing 30 may be coupled, and provided with a socket 25 for supplying electric power supplied through the transmission line 13 to the substrate 31 of the illumination unit housing 30.

The frame body 23 has an annular structure, an upper side of which is opened, and a plurality of connecting frames 21 that extend from an inner surface of the annular structure to the center thereof.

The connecting frames 21 may be integrally formed with or manufactured separately from the frame body 23, and each of the connecting frames 21 has a hollow portion which is communicated with the vertical through-hole 14 of the connector 12 of the power source housing 10 and connected to the frame body 23. The transmission lines 13 of the power source housing 10 may extend to an inside of the frame body 23 through the hollow portions.

The transmission lines 13 located in the frame body 23 are connected to sockets which are through-holes provided on the lower side of the coupling unit 22 of the frame body 23.

The opened upper side of the frame body 23 is closed by an upper cover 24.

The illumination unit housing 30 is coupled to the coupling unit 22, and electric power is supplied to the illumination unit housing 30 through a socket provided at a lower portion of the coupling unit 22.

Figure 5:
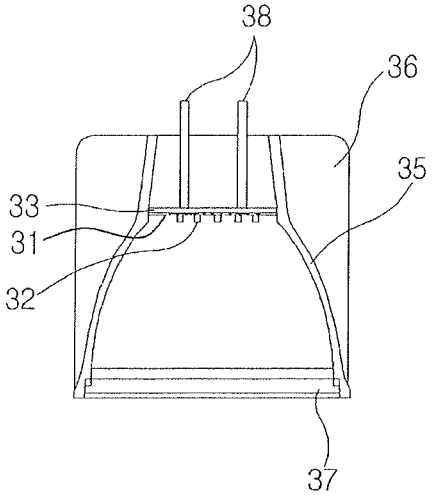
FIG. 5 is a sectional view showing an illumination unit housing applied to the present invention.

FIG. 5 is a sectional view of the illumination unit housing 30.

Referring to FIG. 5, the illumination unit housing 30 includes a body 35 having a reflective surface on an inner surface thereof, a power source terminal 38 fixed to an upper central portion of the body 35 and inserted into the socket to receive electric power of an electric wire 13 when being coupled to the coupling unit 22, an insulating plate 33 fixing the power source terminal 38 while insulating the power source terminal 38 from the body 35, a substrate 31 fixed to a lower portion of the insulating plate 33 to receive electric power while contacting the power source terminal 38, an LED mounted to a bottom surface of the substrate 31 to emit light, a heat radiating fin 36 provided on a side surface of the body 35, and a light transmitting cover 37 provided at a lower side of the body 35.

An inner side of the body 35 may become a minor through a processing method such as silver plating to reflect light more efficiently.

The illumination unit housings 30 are coupled to the coupling units 22, respectively, and receive electric power through the power source terminal 38 to project concentrated light to a lower side.

If the illumination unit housings 30 are circularly arranged in the ring-shaped frame 20, an intensity of illumination is improved and energy is saved.

The illumination unit housings 30 are selectively coupled to the coupling units 22 such that a distribution of light and an intensity of illumination can be adjusted.

The diameter of the illumination housing 30 on a plane is larger than the a width of the frame body 23 of the frame 20 on the upper side thereof, and accordingly, air may smoothly flow between the heating radiating fins 36 on the outer side of the illumination housing 30, preventing lowering of heat radiation characteristics.

The shape of the body 35 of the illumination housing 30 may be changed if necessary, and any light distribution and intensity of illumination by which light emitted from the LEDs 32 mounted to the substrate 31 fixedly inserted into the body 35 of the illumination housing 30 that can be effectively reflected may be used irrespective of the structure.

The insulating plate 33 having a through-hole 34 through which the power source terminal 25 passes may be used to fix a position of the power source terminal 35 and prevent a short-circuit, but the insulating plate 33 may be omitted according to a shape of an electrode (not shown) provided on the upper side of the substrate 31 and the electrode of the substrate 31 may directly contact the power source terminal 25.

In this structure, heat generated by the LEDs 32 is emitted from the heat radiating fins 36 provided on the outer side of the illumination unit housing 30, and air can easily rise through the space between the frame 20 and the power source housing 10 as the heat is emitted, so that air can smoothly flow through the illumination unit housing 30 due to the air flow, further improving heat radiation characteristics.

Because the power source housing 10 is connected to the connecting frame 21 through the connector 12 provided in an extremely partial portion thereof, it is difficult to transfer heat generated by the power supply 11 accommodated in the power source housing 10 to the illumination unit housing 30 in which the LEDs 32 and the substrate 31 are accommodated, and thus a life span of the LEDs 32 can be prevented from being shortened by the heat generated by the power supply 11.

It will be appreciated by those skilled in the art to which the present invention pertains that the present invention is not limited to the embodiment and may be variously modified without departing from the spirit of the present invention.

The present invention blocks heat generated by an illumination unit and a power supply unit such that the heat may not be transferred between the illumination unit and the power supply unit, thereby preventing damage to the illumination unit and the power supply unit and adjusting an intensity of illumination if necessary.

The invention claimed is:

1. An LED lighting apparatus comprising:

a power source housing having a power supply therein, a plurality of connectors on a lower surface thereof and heat radiating fins that radially extend from an upper central surface of the power source having a plurality of heat reading fins housing;

an annular frame having a connecting frame coupled to the connectors of the power source housing and in which a transmission line for supplying electric power of the power supply is accommodated; and a plurality of illumination unit housings coupled to a lower portion of the frame to receive electric power through the transmission line for applying the electric power to an accommodating LED to emit light, wherein the annular frame include a coupling unit coupled to the plurality of illumination unit housings, and wherein an inner diameter of the annular frame is provided to be larger than an outer diameter of the power source housing, the annular frame is arranged between the power source housing and the illumination unit housing and spaced apart from the power source housing and the illumination unit housing to each other.

2. The LED lighting apparatus of claim 1, wherein the power source housing has a space for accommodating the power supply therein, and wherein a vertical through-hole for extending the transmission line of the power supply to an inside of the frame through the connecting frame is provided inside each of the plurality of connectors.

3. The LED lighting apparatus of claim 2, wherein the frame comprises:

an annular frame body, an upper side of which is opened and a portion of the transmission line is accommodated;

the coupling unit provided on a bottom surface of the frame body and to which the illumination unit housing is coupled; and a socket provided on a bottom surface of the coupling unit.

4. The LED lighting apparatus of claim 3, wherein the illumination unit housing has:

a body, an inner surface of which is a reflective surface;

an insulating plate located on an upper surface of the body;

a power source terminal passing through the insulating plate and inserted into the socket to receive electric power; and a substrate for receiving electric power through the power source terminal and supplying the electric power to the mounted LED.

5. The LED lighting apparatus of claim 4, wherein, in the body of the illumination housing, a plurality of heat radiating fins are vertically formed on a side surface thereof, and a diameter thereof is larger than a width of the frame.

6. The LED lighting apparatus of claim 1, wherein the frame comprises:

an annular frame body, an upper side of which is opened and a portion of the transmission line is accommodated;

the coupling unit provided on a bottom surface of the frame body and to which the illumination unit housing is coupled; and the socket is provided on a bottom surface of the coupling unit.

7. The LED lighting apparatus of claim 6, wherein the illumination unit housing has:

a body, an inner surface of which is a reflective surface;

an insulating plate located on an upper surface of the body;

a power source terminal passing through the insulating plate and inserted into the socket to receive electric power; and a substrate for receiving electric power through the power source terminal and supplying the electric power to the mounted LED.

8. The LED lighting apparatus of claim 6, wherein, in the body of the illumination housing, a plurality of heat radiating fins are vertically formed on a side surface thereof, and a diameter thereof is larger than a width of the frame.

* * * * *